US006181311B1

(12) United States Patent
Hashimoto

(10) Patent No.: US 6,181,311 B1
(45) **Date of Patent: *Jan. 30, 2001**

(54) LIQUID CRYSTAL COLOR DISPLAY APPARATUS AND DRIVING METHOD THEREOF

(75) Inventor: Seiji Hashimoto, Yokohama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/804,370

(22) Filed: Feb. 21, 1997

(30) Foreign Application Priority Data

Feb. 23, 1996 (JP) ..... 8-060278
Feb. 23, 1996 (JP) ..... 8-060279
Feb. 21, 1997 (JP) ..... 9-036821

(51) Int. Cl.[7] ..... G09G 3/36
(52) U.S. Cl. ..... 345/98; 345/90; 345/102; 345/88
(58) Field of Search ..... 345/88, 87, 90, 345/92, 91, 93, 98, 99, 100, 102

(56) References Cited

U.S. PATENT DOCUMENTS 4,870,396 * 9/1989 Shields ..... 345/90
5,172,249 * 12/1992 Hashimoto ..... 358/482
5,337,068 * 8/1994 Stewarts et al. ..... 345/88
5,619,225 * 4/1997 Hashimoto ..... 345/98
5,694,145 * 12/1997 Kondo et al. ..... 345/90

FOREIGN PATENT DOCUMENTS 63-41078 * 8/1988 (JP) .

* cited by examiner

*Primary Examiner*—Xiao Wu
(74) *Attorney, Agent, or Firm*—Fitzpatrick, Cella, Harper & Scinto

(57) ABSTRACT

A liquid crystal display apparatus employing a light source color switching system is provided for full color display. This apparatus improves display characteristics by securing a sufficient writing time and preventing afterimage phenomenon caused by residual charges. In the apparatus, while all the picture elements in displaying portion 14 are displaying the preceding color according to image signals for the preceding display color transmitted to liquid crystal capacitors 5 and additional capacitors 4, subsequent image signals are stored concurrently in a memory capacitors 2 through first TFTs 1 with second TFTs 3 turned off. Then, reset TFTs 6 are turned on to reset the image signals for the preceding display color held in liquid crystal capacitor 5 and additional capacitor 4. Then the second TFTs 3 on all the picture elements in displaying portion 14 are turned on to transmit the image signals stored in the memory capacitors 2 to additional capacitors 4 and liquid crystal capacitor 5 to display the subsequent color.

11 Claims, 9 Drawing Sheets

HSR
12
13
14
VSR
11
ΦHS
ΦH1
ΦH2
H11
H12
H13
Vin
ΦT
Vcom
ΦC
V1
V2
V3
VL1
VL2
VL3
ΦVS
ΦV1
ΦV2
1
2
3
4
5
6

LIQUID CRYSTAL COLOR DISPLAY APPARATUS AND DRIVING METHOD THEREOF

BACKGROUND OF THE INVENTION

1. Field of the Invention

The present invention relates to a liquid crystal display apparatus for full-color display employing a light source color switching system without using a color filter.

2. Related Background Art

A conventional liquid crystal color display apparatus displays a color image by providing color filters 71 of R (red), G (green), and B (blue) on respective liquid crystal picture elements arranged two-dimensionally as shown in FIG. 11. In the color filter type of liquid crystal panel, respective picture elements correspond to one of R, G, and B, and three picture elements in combination display one color picture element. Therefore, the color filter type of liquid crystal display involves the problem that the resolution becomes ⅓, and the light transmittance becomes ⅓ to cause lowering of the display characteristics in comparison with the monochromatic display having the same number of picture elements.

In one method for solving the problem in the color filter system, signals for R, G, and B are sequentially inputted to a monochromatic display liquid crystal panel, and light source colors are switched over synchronously with the respective color signals. For example, in the system disclosed in Japanese Patent Publication No. 63-41078 (1988), writing the signals and display of R, G, and B are conducted sequentially as shown in FIG. 12.

In conventional monochromatic display liquid crystal panels, the writing and the displaying are conducted for every picture element line by employing a sampling-holding circuit to utilize most of the one vertical scanning period for displaying. In contrast thereto, in the aforementioned light source switching system, the vertical scanning is conducted for each color for the one picture. Therefore, when ¾ of the maximum one vertical scanning period is allotted to the displaying to obtain brightness, the time for writing is $(1/3)\times(1/4)=1/12$ for each of the colors. Thus the writing speed is required to be twelve times that of the monochromatic writing. This is not readily realized in view of the performance of TFT.

For color display without increasing the writing speed, one method is to provide a memory for double-speed noninterlace driving in the picture element. In this method, a horizontal scanning line is successively driven, and is transmitted in the vertical retrace period. The period requires several msec depending on the time constant of the horizontal scanning line (gate line) and driving ability of the TFT. More transmission time is required with a larger number of the picture elements.

The memory capacitance should be sufficiently large in comparison with the liquid crystal capacitance. Otherwise, the signal amplitude should be increased. At the capacitance ratio of 10:1, the signal amplitude will be lower by 10%. The liquid crystal should be driven by AC to prevent baking. Therefore, at the maximum amplitude of about 10 V of the AC, the unavailable residual charge in the liquid crystal capacitance is 10% of the signal charge, namely about 1 V, of the memory capacitance. Even if the capacitance ratio is increased to 50:1, the unavailable signal becomes about 200 mV. In the light source switching system in which color signals are sequentially switched, the unavailable signal causes an offensive afterimage to deteriorate the image quality. Furthermore, it is extremely difficult to form the memory capacitance at the capacitance ratio of 50:1 in a limited picture element.

The partitioning of the capacitance into a memory capacitance and a liquid crystal capacitance (including an additional capacitance) causes drop of the signal amplitude. This drop should be compensated by supplying compensating signal voltage from the outside. The memory capacitance and the additional capacitance depend on the film thickness and area of the insulating material. Since the film thickness varies unavoidably in the production process to cause variations of the memory and additional capacitances of the respective picture elements, the liquid crystal capacitance also varies with variation of the thickness of the liquid crystal layer. Therefore, signal voltage from the outside should be adjusted to compensate the variations.

As described above, the high speed writing is indispensable to conventional liquid crystal display apparatuses employing the light source switching system, and accordingly the system for high speed writing involves many technical problems in power consumption, cost, and TFT characteristics, and so forth. Furthermore, the method of providing a memory in the picture element involves problems of picture image deterioration caused by residual charge and undesired increase of the unit picture element area for the memory.

The present invention intends to provide a liquid crystal display apparatus not involving the aforementioned problems. The display apparatus of the present invention realizes full color image display with high fineness and high brightness by employing a liquid crystal display panel without using color filters and without increasing the writing speed, by lengthening the lighting time of the color light source. It is another objective in the display apparatus that variation of the capacitances is decreased.

SUMMARY OF THE INVENTION

The present invention provides a liquid crystal display apparatus, comprising a memory provided in each picture element, and reset means for resetting residual charges of liquid crystal capacitors, and a switching means for transmitting signals from the memory to the liquid crystal capacitors collectively in the whole picture to switch the light source color sequentially and synchronously with the signal transmission, whereby a color image is written during display time of the preceding image to secure a sufficient writing time and to prevent picture image quality deterioration caused by residual charges. The present invention also provides a driving method of the liquid display apparatus.

A first embodiment of the present invention, is an active matrix type liquid crystal display apparatus for full color display employing a light source color switching system, which comprises, in each picture element, a first switching means turned on and off by scanning lines for each picture element line to receive image signals from signal lines; a memory means for holding the image signals from the first switching means; a second switching means for controlling output of the memory from the memory means; a picture element electrode connected to the second switching means; and a reset means for resetting the image signals having been applied to the picture element electrodes.

A second embodiment of the present invention is a method for driving the above liquid crystal display apparatus, which comprises steps of applying image signals to the memory means by turning off the second switching means and turning on the first switching means; resetting the image signals applied to the picture element electrodes by use of the resetting means by turning off the first switching means and the second switching means; transmitting the image signals held in the memory means by turning on the second switching means; and switching the light source color synchronously with the transmission of the image signal to the picture element electrodes, the steps being repeated for the respective light source colors for full color display.

The present invention provides also a liquid display apparatus which comprises, in each picture element, a memory means, and a buffer circuit after the memory means to transmit the signal applied to the memory means at approximately the same amplitude further to the liquid crystal capacitor to secure sufficient time for the displaying and to compensate variation of the capacitance, and also provides a method for driving the liquid display apparatus.

A third embodiment of the present invention is an active matrix type liquid crystal display apparatus for full color display by a light source color switching system, which comprises, in each picture element, a first switching means turned on or off by scanning lines for each picture element line, and receiving image signal from signal lines; a memory means for holding image signals from the first switching means; a buffer means for amplifying the signal charge held by the memory means; and a picture element electrode for receiving the output signals from the buffer means.

A fourth embodiment of the present invention is a driving method of the above liquid crystal display apparatus, which comprises steps of applying image signals to the memory means by turning on the first switching means; amplifying the image signals applied to the memory means by bringing the buffer means to an active state, and transmitting the output signals from the buffer means to the picture element electrodes; and switching the light source colors synchronously with the transmission of output signal to the picture element electrode, the steps being repeated for the respective light source colors for full color display.

A fifth embodiment of the present invention is a method for driving the above liquid crystal display apparatus, which comprises steps of applying image signals to the memory means by turning on the first switching means; resetting the signals applied to the picture element electrodes by a reset means; amplifying the image signals applied to the memory means by bringing the buffer means to an active state, and transmitting the output signals from the buffer means to the picture element electrodes; and switching the light source colors synchronously with the transmission of output signal to the picture element electrode, the steps being repeated for the respective light source colors for full color display.

The present invention gives the effects below:

(1) The constitution is simplified by the memory provided in each of the picture element without decrease of the signal amplitude and without need for adjustment of the signal level to move against the variation of the capacitances;

(2) The power consumption is reduced to lower the operation cost owing to the shortened activation time of the buffer circuit;

(3) The smaller memory capacitance enables increase of the numerical aperture of the picture element to realize brighter display; and (4) A full color display is obtained with high brightness and high fineness owing to the collective transmission of the memory signal for the entire image to the liquid crystal capacitor and the additional capacitor and the resulting shortened time for light source color switching.

DESCRIPTION OF THE PREFERRED EMBODIMENTS (Embodiment 1)

A first embodiment of the present invention is described by reference to drawings.

Figure 1:
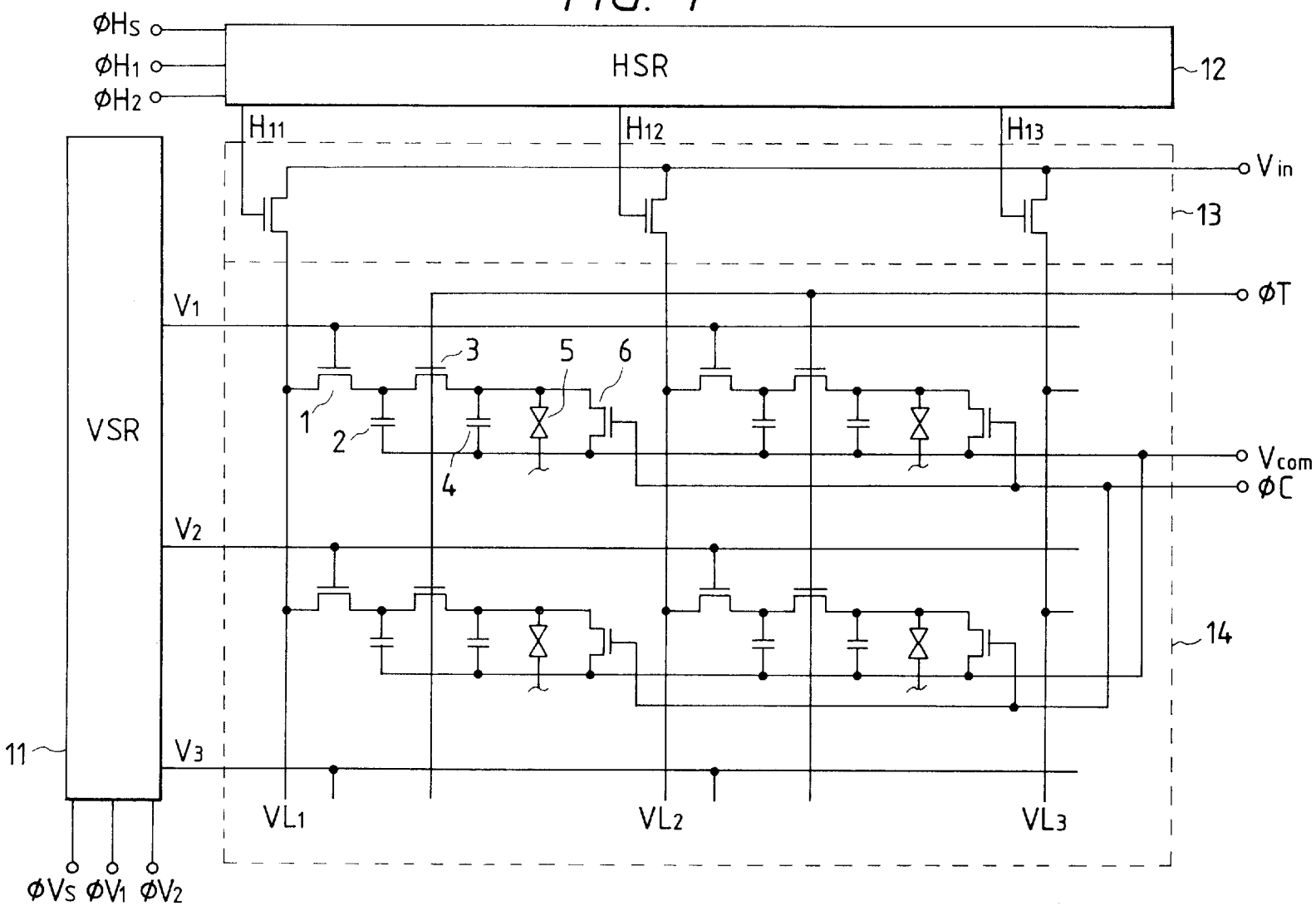
FIG. 1 illustrates constitution of a liquid display panel of the first embodiment of the present invention.

FIG. 1 shows constitution of a display panel of a liquid crystal display apparatus of the present invention. In FIG. 1, numeral 14 denotes a display picture element portion; 11, a vertical scanning circuit; 12, a horizontal scanning circuit; and 13, a sampling circuit which samples input image signals Vin in accordance with pulse signals ($H_{11}$, $H_{12}$, . . . ) The signals sampled from sampling circuit 13 are written into picture elements on the picture element line selected by vertical scanning circuit 11.

Numeral 1 denotes a first TFT as the first switching means; 2, a memory capacitor for holding signals transmitted through first TFT 1; 3, a second TFT as the second switching means for controlling the connection between the memory capacitor and a picture element electrode; 4, an additional capacitor; 5, a liquid crystal capacitor formed by the picture element electrode; 6, a reset TFT as a reset-switching means for controlling the potential of the picture element electrode. First TFT 1 is controlled by pulse signals ($V_1$, $V_2$, . . . ) from vertical scanning circuit 11. The other terminals of memory capacitor 2, additional capacitor 4, and reset TFT 6 are connected together, and the central voltage $V_{com}$ is applied thereto. The gates of the reset TFTs are connected together in the entire display picture element portion 14, enabling collective resetting.

The gates of second TFTs 3 are also connected together in the entire display picture element portion 14, enabling collective transmission of memory signals held by memory capacitors 2 to liquid crystal capacitors 5 and additional capacitors 4. In this embodiment, the first switching means, the second switching means, an reset means are constituted respectively of a single TFT element. They may be respectively constituted of plural elements. The serial connection of the plural elements in constitution of the respective means makes larger the resistance at a non-conduction state to decrease leak current, and reduces defects.

Figure 2:
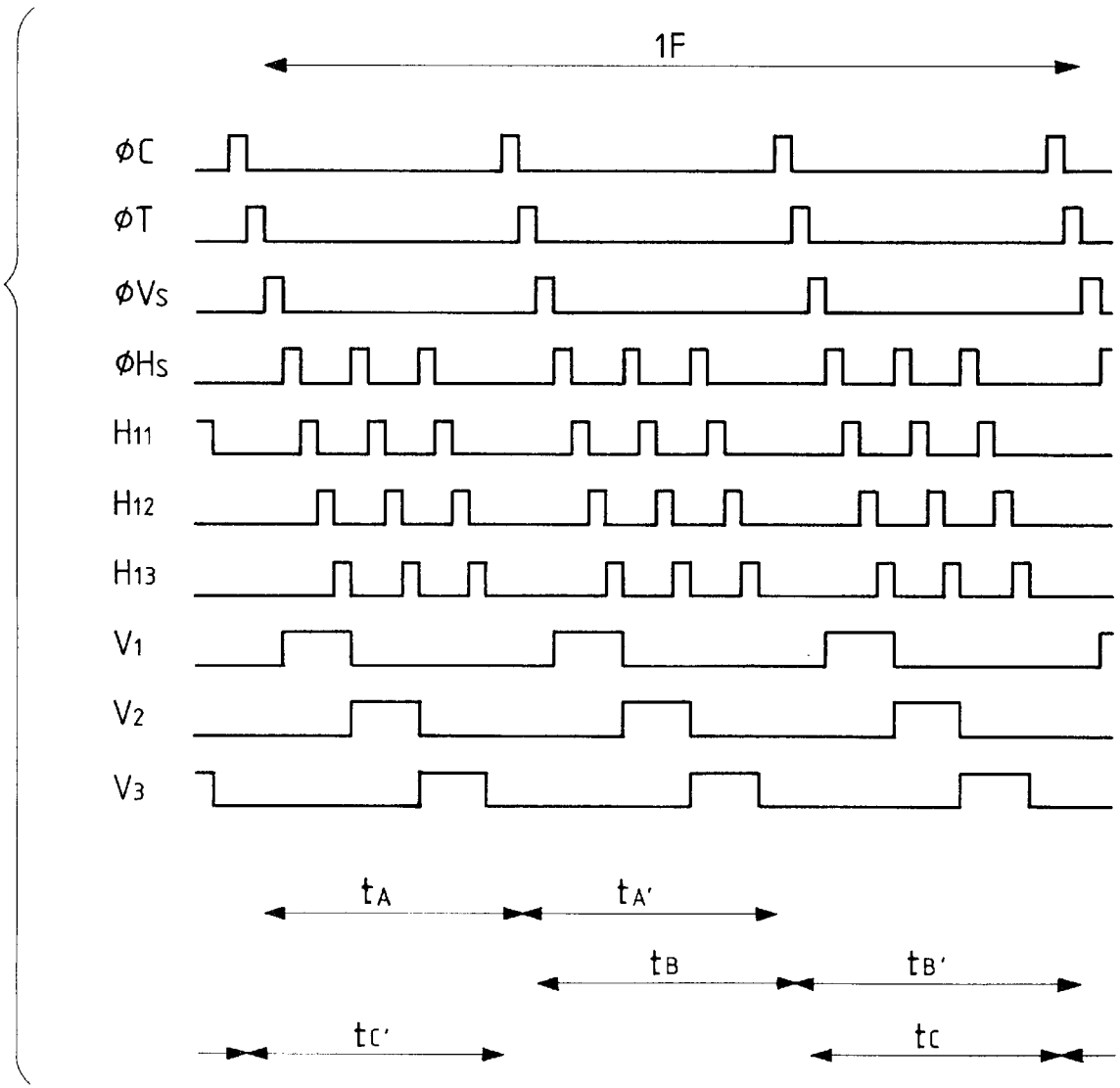
FIG. 2 is a timing chart for driving the liquid crystal panel shown in FIG. 1.

FIG. 2 is a timing chart for driving the display panel of this embodiment. One vertical scanning period (1F) is about 16.7 msec with the signal source of NTSC television signal. Within this period, the light source color is switched over in the order of B, R, and G, and the colors are synthesized visually into a full color display. In period 1F, the symbol $t_A$ denotes an R signal writing period; $t_{A'}$, an R displaying period; $t_B$, a G signal writing period; $t_{B'}$, a G display period; $t_C$, a B signal writing period; and $t_{C'}$, a B display period. The periods of $t_A$ and $t_{C'}$, $t_B$ and $t_{A'}$, and $t_C$ and $t_{B'}$ overlap with each other, respectively. Incidentally, the explanation is made with reference to a liquid display panel having picture elements in 3 lines and 3 columns, for convenience.

In period $t_A$, vertical scanning is started by vertical scanning start pulse $\phi V_s$, and selection pulses $V_1$, $V_2$, and $V_3$ are applied successively from vertical scanning circuit 11 to the vertical scanning line to turn on successively the first TFTs 1 on the respective picture element lines. In each of the selection pulses $V_1$, $V_2$, and $V_3$, horizontal scanning is started by horizontal start pulse $\phi H_s$ to apply successively sampling pulses $H_{11}$, $H_{12}$, and $H_{13}$ to the gates of the sampling TFTs in sampling circuit 13, to sample input image signal $V_{in}$ (R signal). Thus, horizontal scanning is conducted for every line synchronously with the selection pulses. The R signals are transmitted through respective first TFTs 1 to memory capacitor 2, and stored there. During the same period $t_A$, an B display is conducted in accordance with B signal applied in the preceding period to the liquid crystal capacitors 5 and the additional capacitors 4 ($t_{C'}$).

When writing has been finished for all picture element lines, pulse $\phi C$ is applied to the gates of reset TFTs 6 of all of the picture elements to turn on TFTs 6 to reset collectively the B signals in all picture elements held in liquid crystal capacitors 5 and the additional capacitors 4. Subsequently, pulse $\phi T$ is applied to the gate of the second TFTs 3 of all the picture elements to turn on the TFTs 3. Thereby, the R signals held in the memory capacitors are transmitted to additional capacitors 4 and liquid crystal capacitors 5, and simultaneously the light source is switched over to R to conduct R display ($t_{A'}$). The period $t_{A'}$ is also the writing period $t_B$, for G signals, and the G signals are written in the same manner as above.

In such a manner, B, R, and G are successively displayed in period 1F, and the three colors are visually synthesized by afterimage effect to be recognized as a full color display.

In the present invention, the display period can be lengthened by the collective application of signals to liquid crystals of the all picture elements, and ⅓ of period 1F can be secured as the writing period by conducting B, R, and G display synchronously with the writing of R, G, and B. Therefore, the required writing speed is three times that of conventional monochromatic display, which can be realized with the current technique of TFT manufacture and the external signal treatment.

In the present invention, the liquid crystal for high-speed driving is preferably analogue-driven ferroelectric liquid crystal. Binary-driven ferroelectric liquid crystal can be used suitably by time-modulated drive. The ferroelectric liquid crystal can rise or decay within a time length of several tens to several hundreds $\mu$sec.

Figure 3:
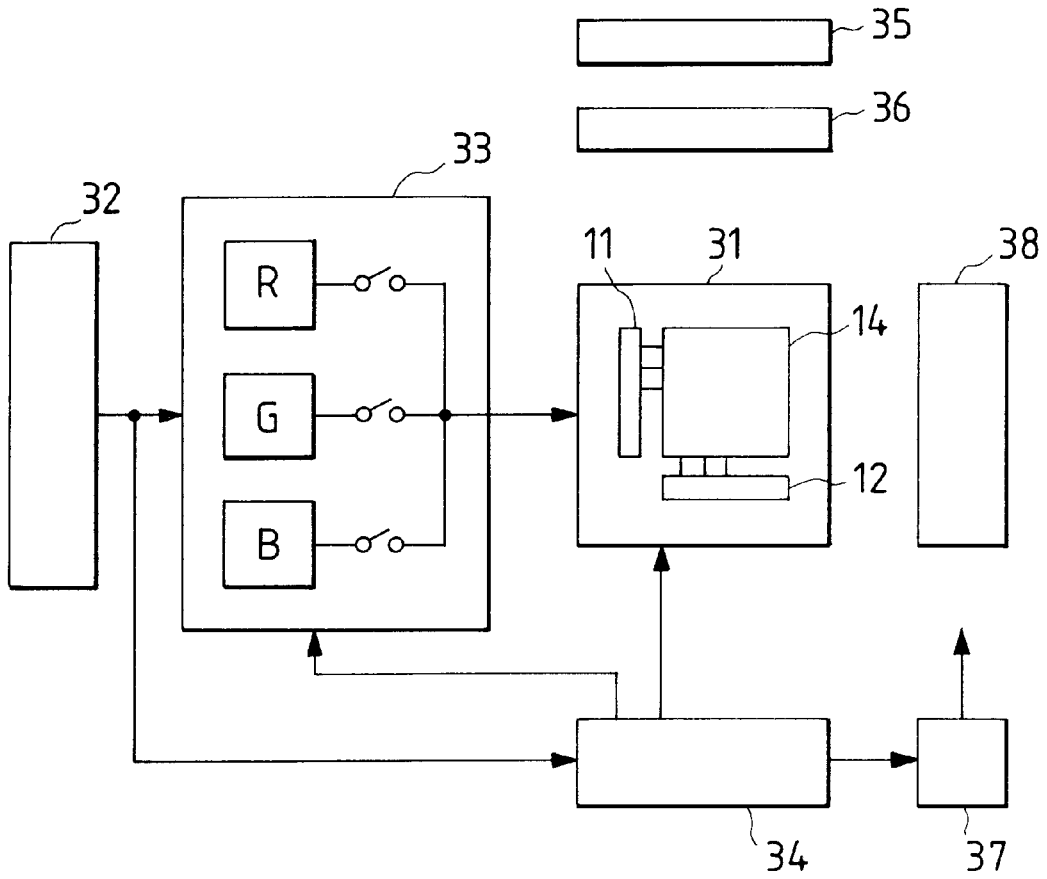
FIG. 3 illustrates constitution of a liquid crystal display apparatus of the first embodiment of the present invention.

FIG. 3 shows entire constitution of a liquid crystal display apparatus of the present invention. In FIG. 3, the numeral 31 denotes a display panel shown in FIG. 1. The numeral 32 denotes a signal source such as record regeneration apparatuses like NTSC and PAL, high-vision apparatuses, and personal computers like VGA, and XGA, and so forth.

Numeral 33 denotes an external signal treatment memory for converting the signals from signal source 32 to drive signals to be transmitted to display panel 31, and outputs plane-sequentially as R, G, and B signals.

Numeral 34 denotes a timing generator for separating synchronized signals from signal source 32, and controls external signal treatment memory 33, driving pulses for display panel 31, illumination voltage control pulses, the system power source, and so forth.

Numeral 37 denotes the power source for the entire system. The numeral 35 denotes an illumination device for illuminating display panel 31, and emits light of color of R, G, or B successively by switch-over of light source color synchronously with transmission of signals of R, G, or B to the liquid crystals. The illumination device 35 is capable of illuminating the panel with R, G, and B colors respectively by separating the colors of single color light sources of R, G, and B, or a white light source through a color separation means. As illumination device 35, combination of the monochromatic light sources such as an LED light sources requires successive power supply to the LED light source employed for displaying each color, resulting in high power efficiency. The numeral 36 denotes an optical system for illumination 35. In display panel 31 of transmission type, optical system 36 is placed on the reverse side of display panel 31, whereas in display panel 31 of reflection type, optical system 36 is placed on the front side of display panel 31. The numeral 38 denotes an optical system for projecting the light from display panel 31.

As described above, in the embodiment of the liquid display apparatus of the present invention, the writing periods for R, G, and B correspond simultaneously and respectively to the display periods for B, R, and G. Therefore, sufficient time length can be secured for the writing, so that full color display can be conducted by a light source color switching system without deterioration of display quality caused by high-speed writing. Moreover, in the present invention, electric charges applied to the liquid crystals of the entire picture elements are reset collectively, whereby a deterioration of the image quality by residual charge is prevented, and full color picture image can be obtained with high image quality.

Figure 4:
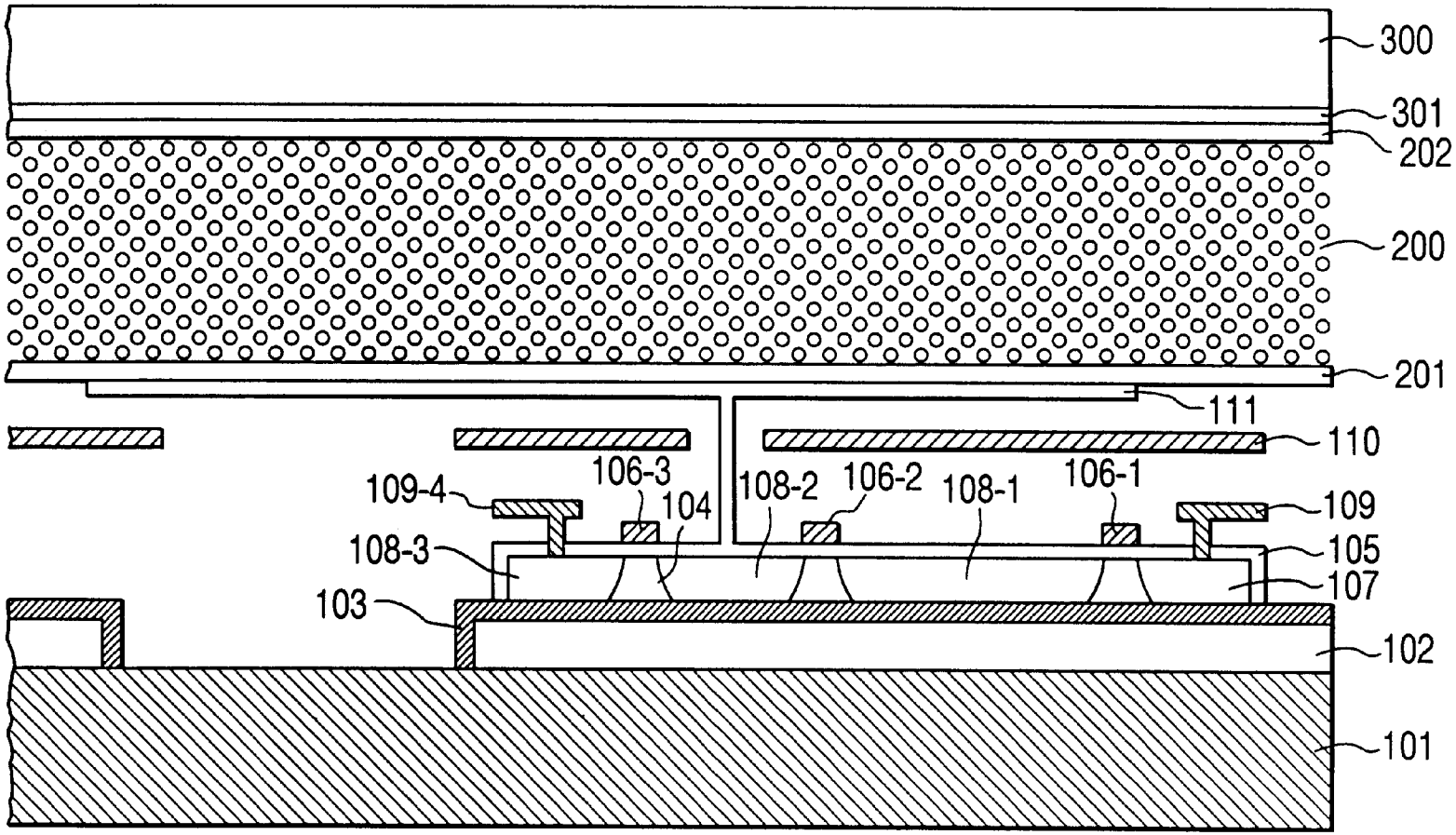
FIG. 4 is a sectional view of a light-transmission type liquid crystal panel of the first embodiment of the present invention.

FIG. 4 is a sectional view of a transmission type panel having memory capacitors and reset TFTs in a picture element portion. Numeral 101 denotes a transparent insulating substrate; 102, an electroconductive film; 103, an insulating film; 104, polysilicon; 105, a gate insulating film; 106-1 to 106-3, gate polysilicon; 107 and 108-1 to 108-3, source and drain regions; 109, signal wiring; 110, electroconductive light-intercepting film; 111, transparent picture element electrode; 201 and 202, orientation films; 200, liquid crystal; 301, a transparent electroconductive film; and 300, a glass substrate. In the example, the memory capacitance is constituted of the capacitance between drain region 108-1 and electroconductive film 102, and the additional capacitance is constituted of the capacitance between drain region 108-2 and electroconductive film 102 and the capacitance between electroconductive light-intercepting film 110 and transparent picture element electrode 111. Numeral 109-4 denotes a reset potential wiring.

Figure 5:
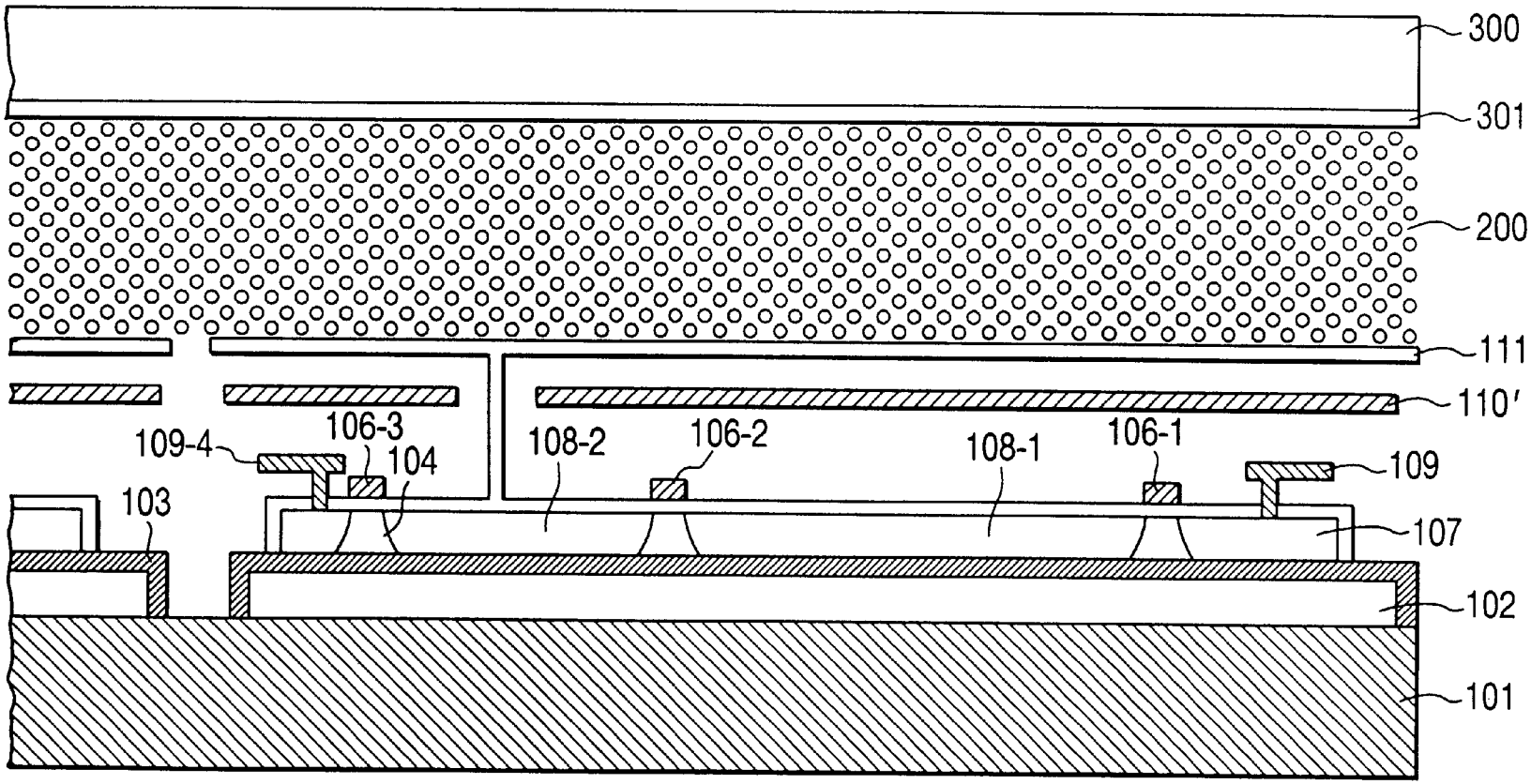
FIG. 5 is a sectional view of a light-reflection type liquid crystal panel of the first embodiment of the present invention.

FIG. 5 is a sectional view of a reflection type panel having a memory capacitor and reset TFT in the picture element portion. In the reflection type panel, substrate 101 is not required to be transparent, and may be a silicon substrate or the like. Electroconductive light-intercepting film 110' also is not required to be light-intercepting provided that it serves as an electroconductive film for capacitor formation. The reflection type panel is not required to have an aperture for light transmission. Therefore memory circuit and the buffer means are integrated more readily under the picture element electrodes.

(Embodiment 2)

A second embodiment of the present invention is described by reference to drawings.

Figure 6:
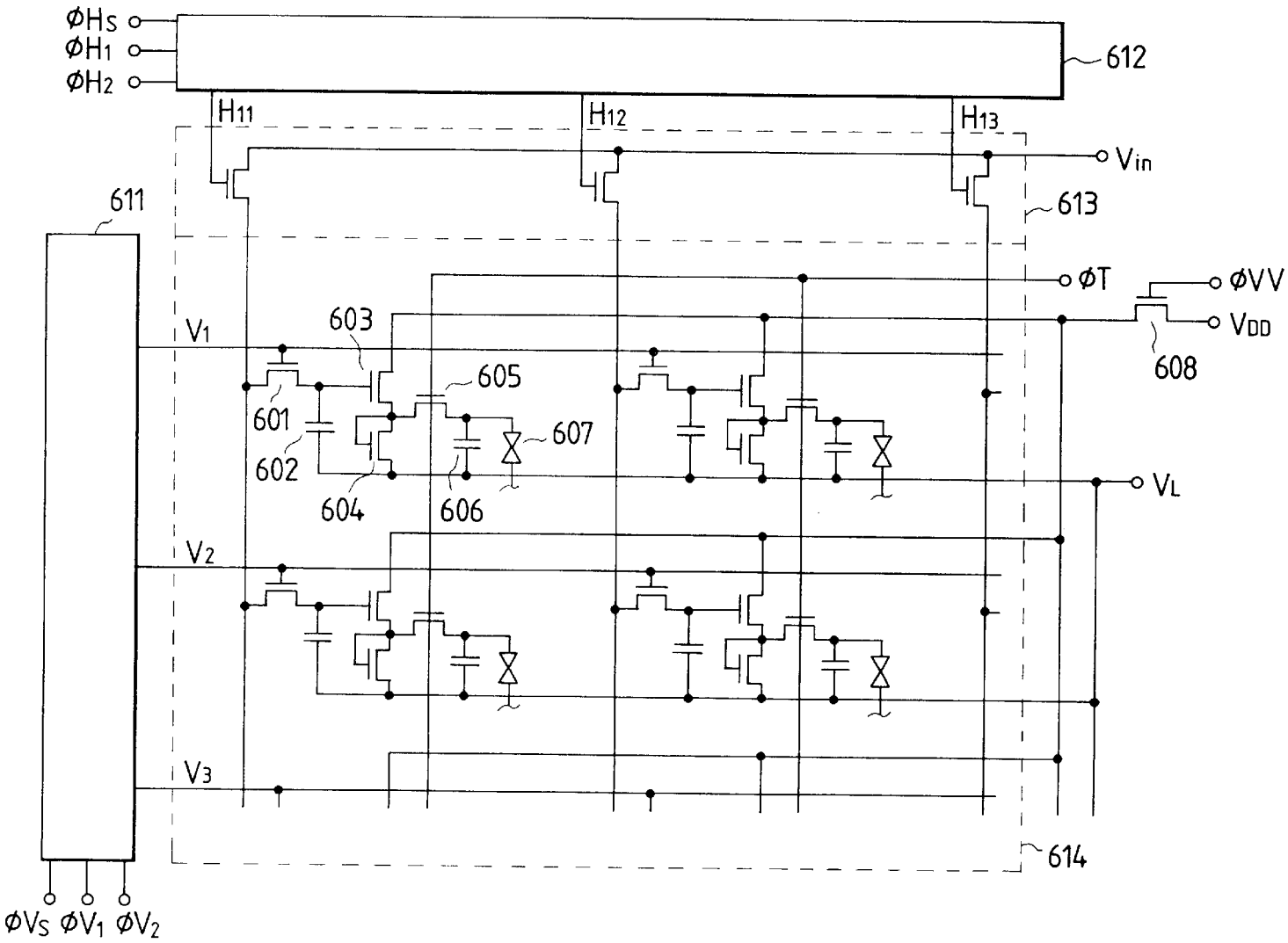
FIG. 6 illustrates constitution of a liquid crystal panel of the second embodiment of the present invention.

FIG. 6 shows an embodiment of a display panel of a liquid display apparatus of the present invention. In FIG. 6, the numeral 614 denotes a display picture element portion; 611, a vertical scanning circuit; 612, a horizontal scanning circuit; and 613, a sampling circuit which samples input image signals $V_{in}$ in accordance with pulse signals ($H_{11}$, $H_{12}$, . . . ). The signals sampled from sampling circuit 613 are written into picture elements on the picture element line selected by vertical scanning circuit 611.

Each picture element is constituted of the first switch circuit 601 as the first switching means, memory capacitor 602 as a memory means, a buffer circuit comprising amplification circuit 603 and load resistance 604, the second switch circuit 605, additional capacitor 606; and liquid crystal capacitor 607 formed from a picture element electrode. In the buffer circuit, the drain of amplification circuit 603 is connected through power switch 608 to the power source $V_{DD}$, and load resistance 604 is connected to power source $V_L$. Power voltage $V_{DD}$ is applied to amplification circuit 603 by turning on power switch 608 on by pulse $\phi VV$ to activate the buffer circuit.

The output signal of the buffer circuit is transferred to additional capacitor 606 and liquid crystal capacitor 607 by control of the second switch 605.

Figure 7:
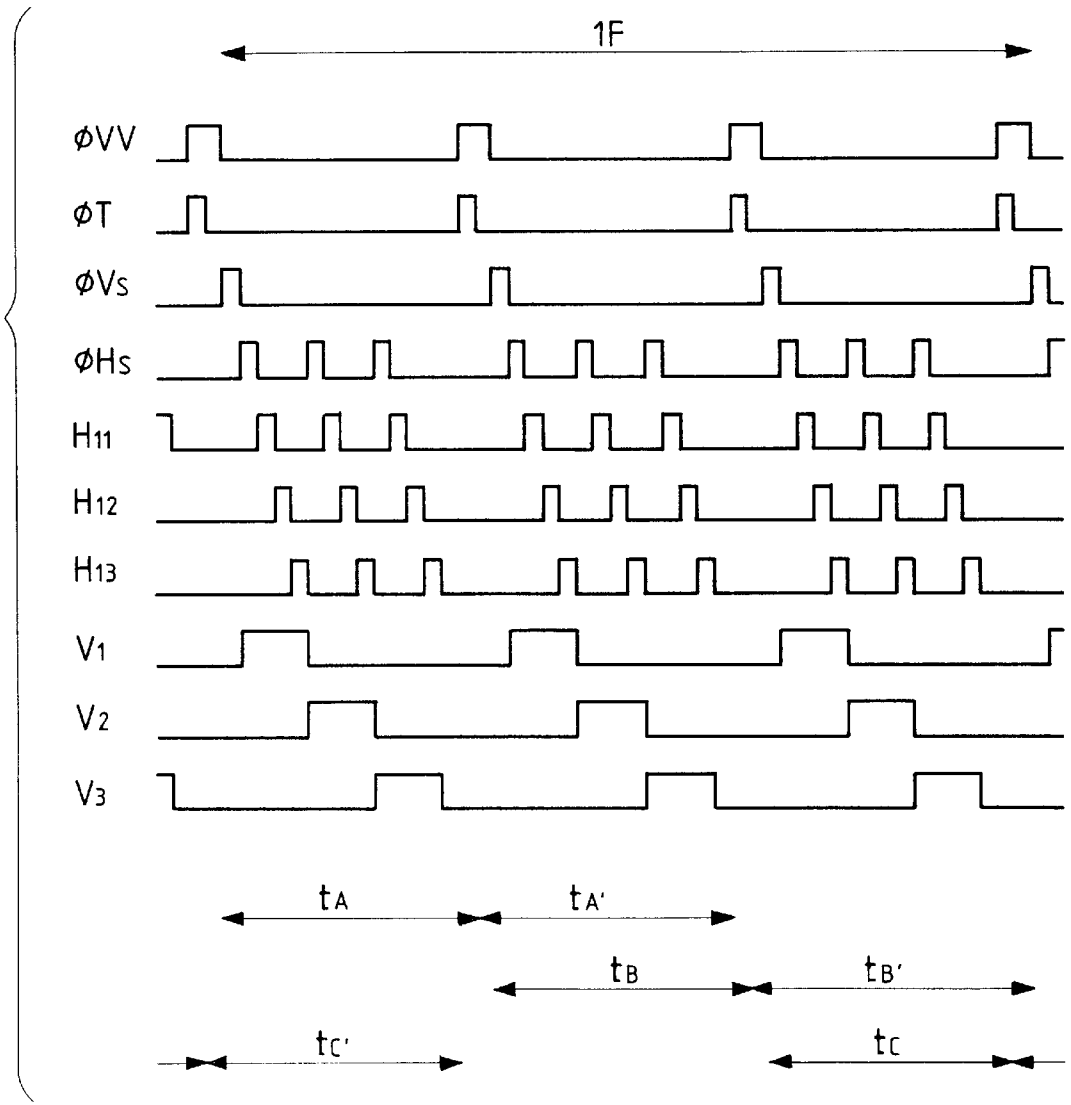
FIG. 7 is a timing chart for driving the liquid crystal panel of the second embodiment.

FIG. 7 is a timing chart for driving the display panel of this second embodiment. One vertical scanning period (1F) is about 16.7 msec with the signal source of NTSC. Within this period, the light source colors are switched over in the order of B, R, and G, and the colors are synthesized visually into a full color display. In period 1F, symbol $t_A$ denotes an R signal writing period; $t_{A'}$, an R displaying period; $t_B$, a G signal writing period; $t_{B'}$, a G display period; $t_C$, a B signal writing period; and $t_{C'}$, a B display period. The periods of $t_A$ and $t_{C'}$, $t_B$ and $t_{A'}$, and $t_C$ and $t_{B'}$ overlap with each other, respectively. Incidentally, the explanation is made by reference to a liquid display panel having picture elements in 3 lines and 3 columns as an example for convenience.

In period $t_A$, vertical scanning is started by vertical scanning start pulse $\phi V_S$. Thereby, selection pulses $V_1$, $V_2$, and $V_3$ are applied successively from vertical scanning circuit 611 to the vertical scanning lines to turn on successively the first switch circuits 601 on the respective picture element lines. In each of the selection pulses $V_1$, $V_2$, and $V_3$, horizontal scanning is started by horizontal start pulse $\phi H_S$ to apply successively sampling pulses $H_{11}$, $H_{12}$, and $H_{13}$ to the gates of the sampling TFTs in sampling circuit 13, to sample input image signal $V_{in}$ (R signal). Thus, horizontal scanning is conducted for every lines synchronously with the selection pulses. The R signals are transmitted through respective first switch circuits 601 to memory capacitor 602, and stored there. During the same period $t_A$, an B display is conducted in accordance with B signal applied in the preceding period to the liquid crystal capacitors 607 and the additional capacitors 606 ($t_{C'}$).

At the time when the writing has been completed, pulse $\phi VV$ is applied to the gate of power switch 608 to turn it on and activate the buffer circuit of all of the picture elements. Simultaneously, pulse $\phi T$ is applied to the gates of second switch circuits 605 of all the picture elements to turn on the switches. Thereby, the output signals in the buffer circuit are transmitted to additional capacitor 606 and liquid crystal capacitor 607, and simultaneously the light source is switched to R to conduct R display ($t_{A'}$). The period $t_A$ is also the writing period $t_B$ for the G signals, and the G signals are written in the same manner as above.

The output signals from the above buffer circuits are approximately equal to the signal voltage of memory capacitor 602 because the amplification ratio is approximately 1. Therefore, the image signal held in memory capacitor 602 is written as the output signal of the buffer circuit into additional capacitor 606 and liquid crystal capacitor 607 without decrease of the amplitude.

In such a manner, B, R, and G are successively displayed in period 1F, but the three colors are visually synthesized by afterimage effect and are recognized as full color display.

In the present invention, the display period is lengthened by the collective application of signals to liquid crystals of the all picture elements, and ⅓ of period 1F is secured as the writing period by conducting B, R, and G display synchronously with the writing of R, G, and B. Therefore, the required writing speed is three times that of conventional monochromatic display, which can be realized with the current technique of TFT manufacture and the external signal treatment.

In the present invention, the liquid crystal for high-speed driving is preferably analogue-driven ferroelectric liquid crystal. Binary-driven ferroelectric liquid crystal can be used suitably by time-modulated drive. The ferroelectric liquid crystal can rise or decay within a time length of several tens to several hundreds $\mu$sec.

In the present invention, the buffer circuits are provided additionally in comparison with conventional memory systems. However, since the memory capacitance can be approximately at the same level as the liquid crystal capacitance, the area of the picture element unit can be decreased by designing the buffer circuit smaller than the conventional memory area. Further, the buffer circuit is activated only at the time of transmittance of the output signals to the liquid crystal capacitors to make negligible the power consumption increase, and the leakage current of TFTs, and the heat generation can be prevented.

In the liquid display panel shown in FIG. 6, the other ends of memory capacitors 602, load resistances 604, and additional capacitors 606 are kept at the same potential $V_L$ to decrease the number of the power source lines. However, the potentials may be different.

The general constitution of the liquid display apparatus of the above embodiment is the same as that of the first embodiment shown in FIG. 3.

(Embodiment 3)

Figure 8:
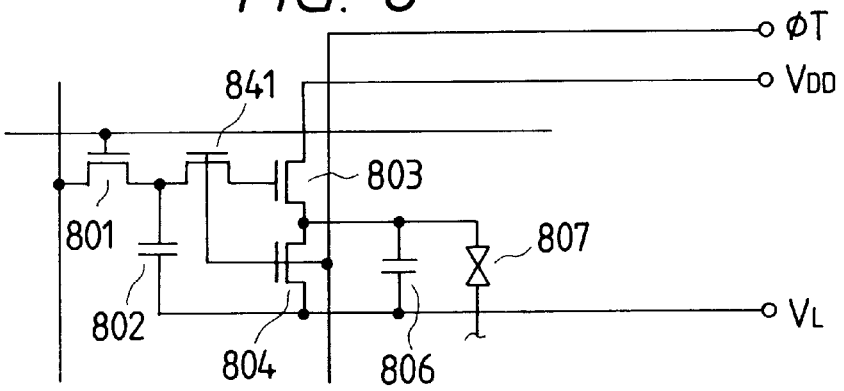
FIG. 8 shows one picture element of a display panel of the third embodiment.

FIG. 8 shows a buffer circuit of a third embodiment of the present invention. This buffer circuit has memory control switch circuit 841 provided between memory capacitor 802 and amplification circuit 803, and controls simultaneously the switch circuit 841 and load resistance 804 by pulse $\phi T$. In this embodiment, the power source for amplification circuit 803 is $V_{DD}$ invariably. The signal application from memory capacitor 802 is controlled by switch circuit 841. Therefore, the power source voltage $V_{DD}$ need not be controlled.

(Embodiment 4)

Figure 9:
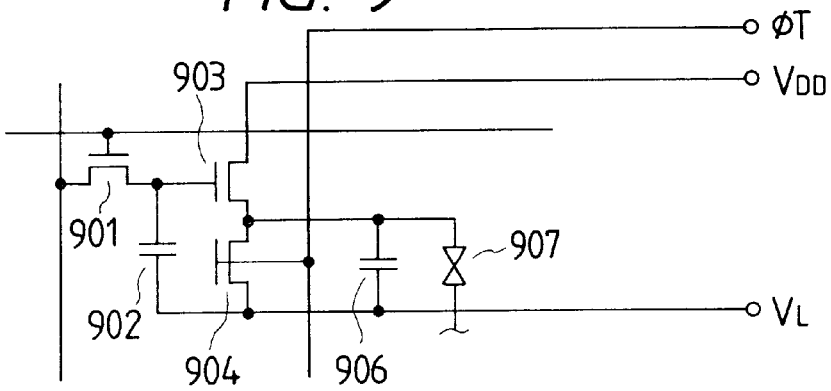
FIG. 9 shows one picture element of a display panel of the fourth embodiment.

FIG. 9 shows a fourth embodiment of the present invention. This embodiment is different from the liquid crystal panel shown in FIG. 6 in that the second switch circuit 905 is omitted and the load resistance 904 is controlled by ϕT. In this embodiment, TFTs constituting a unit picture element are decreased by one TFT unit in comparison with the embodiment shown in FIG. 6. Therefore, the effective numerical aperture can be increased for the transmission type, and the freedom in design can be made sufficient for the reflection type, to reduce defects of the picture element.

(Embodiment 5)

Figure 10:
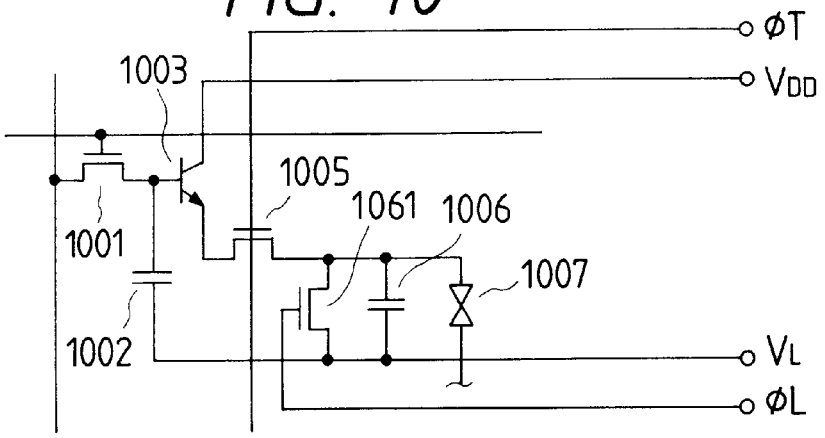
FIG. 10 shows one picture element of a display panel of the fifth embodiment.
Figure 11:
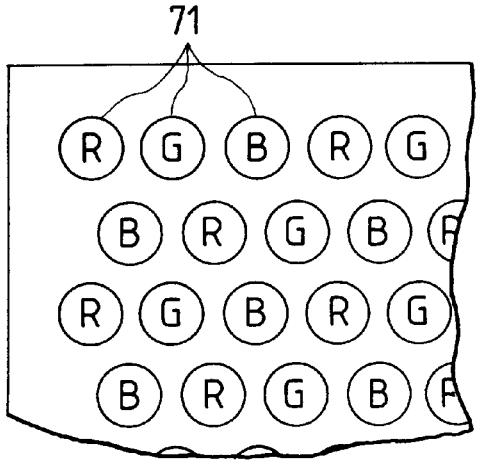
FIG. 11 shows a color filter of a conventional liquid display apparatus.
Figure 12:
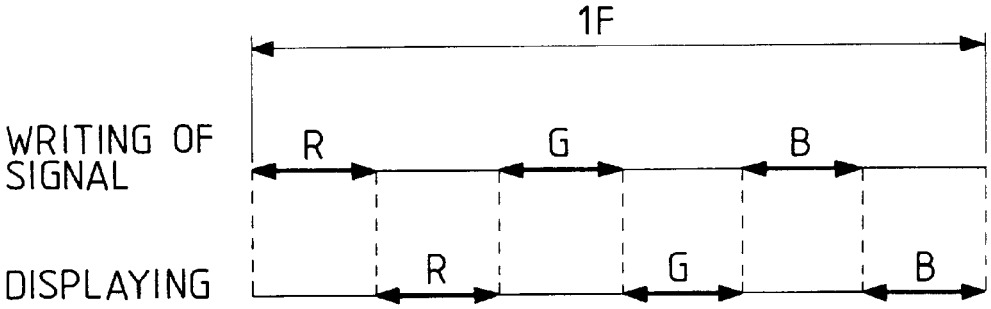
FIG. 12 is a timing chart for writing and display of a conventional liquid crystal display apparatus of light source color switching system.

FIG. 10 shows the fifth embodiment of the present invention. In this embodiment, the amplification circuit 1003 of the buffer circuit is constituted of a bipolar transistor, and a reset switch 1061 is provided for resetting the residual voltage in additional capacitors 1006 and liquid crystal capacitors 1007. Image signals are written into respective memory capacitors 1002, reset switches 1061 of all the picture elements are turned on by ϕC to adjust the residual voltages of additional capacitors 1006 and liquid crystal capacitor 1007 to be $V_L$, and the second switches 1005 are turned on to transmit new signals to additional capacitors 1006 and liquid crystal capacitors 1007.

In this embodiment, the residual voltages of all picture elements are reset collectively, whereby afterimage phenomenon is prevented and the image quality is improved.

What is claimed is:

1. A display apparatus comprising:

a) an active matrix circuit comprising:

i) a first circuit comprising plural first switch means arranged along plural rows and plural columns, scanning lines for connecting commonly per each column said plural first switch means and for supplying thereto an image signal, vertical scanning means for driving the scanning line, and horizontal driving means for driving the signal line; and ii) a second circuit comprising plural memory means, respective ones of said plural memory means connected to every plural first switching means for holding the image signal supplied from the signal lines at turning on of said first switch means on the scanning line scanned by said vertical scanning means, plural second switch means connected and arranged per every one of said plural memory means for outputting collectively each of memory contents from said plural memory means, plural pixel electrodes connected and arranged per every one of said plural second switch means, and reset means for collectively resetting the image signal supplied per every one of said pixel electrodes;

b) a light source for emitting successively a first emission light color and a second emission light color, different from each other in respectively different periods; and c) control means for controlling said active matrix circuit and said light source, so that said first circuit operates to output from the signal line the image signal for the first emission light color, and at that time said second switch of said second circuit is set at an off state, and while the image signal is held at each of said plural memory means, said light source emits the second emission color, and said reset means operates after a termination of light emission of the second emission color, and thereafter, said second switch is turned on to output collectively the memory contents from each of said plural memory means, and at that time said light source emits the first emission color.

2. A display apparatus according to claim 1, wherein said reset means resets collectively the image signal supplied to every one of said pixel electrodes for all pixels.

3. A display apparatus according to claim 1, wherein said second switch means transfers collectively the image signal held in every one of said plural memory means for all pixels to said every pixel electrodes.

4. A display apparatus according to claim 1, wherein said pixel electrode is connected to a liquid crystal.

5. A display apparatus according to claim 1, further comprising:

buffer means for amplifying charge relating to the image signal held in said plural memory means.

6. A display apparatus according to claim 5, wherein said buffer means is controlled into an electrically continuous state and into an electrically discontinuous state.

7. A display apparatus according to claim 5, further comprising:

means for controlling the transfer of an output from said buffer means to the pixel electrode.

8. A display apparatus according to claim 5, wherein for all pixels, an output from said buffer means is supplied to the pixel electrode.

9. A display apparatus according to claim 4, wherein said liquid crystal is ferroelectric liquid crystal.

10. A display apparatus according to claim 1, wherein said light source emits red colored emission light, green colored emission light and blue colored emission light.

11. A display apparatus according to claim 1, wherein said first and second switches comprise TFTs.

* * * * *

UNITED STATES PATENT AND TRADEMARK OFFICE

CERTIFICATE OF CORRECTION

PATENT NO. : 6,181,311 B1
DATED : January 30, 2001
INVENTOR(S) : Seiji Hashimoto It is certified that error appears in the above-identified patent and that said Letters Patent is hereby corrected as shown below:

Title page,
Item [57] ABSTRACT,
Lines 13, 14 and 17, "capacitor" should read -- capacitors --;

Column 3,
Line 54, "element" should read -- elements --.

Column 4,
Line 46, "Vin" should read -- $V_{in}$ --; and
Line 47, "$H_{12}$, ...)" should read -- $H_{12}$, ...). --.

Column 5,
Line 3, "an" should read -- and a --; and
Line 34, "an" should read -- a --; and "B" should read -- a B --.

Column 6,
Line 24, "combination" should read -- a combination --;
Line 25, "sources" should read -- source --; and
Line 26, "successive" should read -- a successive --.

Column 7,
Line 48, "columns as an example" should read -- columns, --;
Line 59, "lines" should read -- line --;
Line 62, "an" should read -- a --; and
Line 63, "B" should read -- a B --.

Column 8,
Lines 5 and 6, "capacitor" should read -- capacitors --;
Line 7, "period $t_A$" should read -- period $t_A'$ --;
Line 16, "decrease" should read -- a decrease --;
Line 22, "the all" should read -- all the --;
Line 23, "display" should read -- displays --; and
Line 34, "hundreds" should read -- hundreds of --.

UNITED STATES PATENT AND TRADEMARK OFFICE

CERTIFICATE OF CORRECTION

PATENT NO. : 6,181,311 B1
DATED : January 30, 2001
INVENTOR(S) : Seiji Hashimoto It is certified that error appears in the above-identified patent and that said Letters Patent is hereby corrected as shown below:

Column 10,
Line 23, "electrodes." should read -- electrode. --.

Signed and Sealed this

Twenty-ninth Day of January, 2002

*Attest:*

*Attesting Officer*

JAMES E. ROGAN
*Director of the United States Patent and Trademark Office*